US008881946B2

(12) United States Patent
Lee et al.

(10) Patent No.: US 8,881,946 B2
(45) Date of Patent: Nov. 11, 2014

(54) COMPACT CONTAINER HAVING AN AIRLESS PUMP

(75) Inventors: Do Hoon Lee, Bucheon (KR); Jae Kwang Hwang, Seoul (KR)

(73) Assignees: Pum-Tech Korea Co. Ltd, Incheon (KR); F.S. Korea Industries, Seoul (KR)

( * ) Notice: Subject to any disclaimer, the term of this patent is extended or adjusted under 35 U.S.C. 154(b) by 0 days.

(21) Appl. No.: 13/575,990

(22) PCT Filed: Apr. 20, 2010

(86) PCT No.: PCT/KR2010/002479

§ 371 (c)(1),
(2), (4) Date: Jul. 30, 2012

(87) PCT Pub. No.: WO2011/099675

PCT Pub. Date: Aug. 18, 2011

(65) Prior Publication Data

US 2012/0305606 A1 Dec. 6, 2012

(30) Foreign Application Priority Data

Feb. 12, 2010 (KR) ..... 20-2010-0001601 U

(51) Int. Cl.
*B65D 35/54* (2006.01)
*A45D 34/00* (2006.01)
*A45D 33/02* (2006.01)

(52) U.S. Cl.
CPC ..... *A45D 34/00* (2013.01); *A45D 33/02* (2013.01); *A45D 2200/056* (2013.01)
USPC ..... 222/96; 222/105; 222/256; 222/321.9; 222/383.1; 222/387; 132/299

(58) Field of Classification Search
USPC ..... 222/92–107, 256, 325–327, 372, 383.1, 222/386, 387, 321.9, 464.7, 212; 132/299; 53/420
See application file for complete search history.

(56) References Cited

U.S. PATENT DOCUMENTS 5,052,592 A * 10/1991 Wilken et al. ..... 222/212
5,788,123 A * 8/1998 Hackmann et al. ..... 222/153.13

(Continued)

FOREIGN PATENT DOCUMENTS

JP 3153523 U9 8/2009
KR 20-0421315 Y1 7/2006

(Continued)

OTHER PUBLICATIONS

International Search Report of PCT/KR2010/002479.

*Primary Examiner* — Paul R Durand
*Assistant Examiner* — Andrew P Bainbridge
(74) *Attorney, Agent, or Firm* — Justin H. Kim, Esq.; Maxon IP LLC.

(57) ABSTRACT

The present invention relates to a compact container having an airless pump, and more particularly, to a compact container for discharging cosmetic in preset amount when the pump is driven by pressing a button. The compact container having an airless pump, includes: a casing including an upper case and a lower case and accommodating cosmetics; a cylinder fixed to the inside of the lower case and having an annular outer wall downwardly extending from the rim, a depression formed at the center concentric with the outer wall, an opening formed at the lower side of the depression such that the opening communicates with the inner space of the outer wall; a plate upwardly spaced apart from the cylinder and having a discharging hole, formed at the center, through which the cosmetics is discharged, and a through-hole formed at a side thereof; an annular container piston elevating up and down along the inner circumference of the outer wall of the cylinder; an airless pump installed at the depression of the cylinder to discharge the cosmetics accommodated in the cylinder to the outside; and a button formed at the through-hole to operate the airless pump.

2 Claims, 5 Drawing Sheets

(56) References Cited

U.S. PATENT DOCUMENTS

| | | | | |
|---|---|---|---|---|
| 6,983,865 | B2 * | 1/2006 | Cabarroque et al. | 222/153.13 |
| 7,040,507 | B2 * | 5/2006 | Koike et al. | 222/94 |
| 8,245,884 | B2 * | 8/2012 | Byeon | 222/256 |
| 8,631,975 | B2 * | 1/2014 | Lim | 222/256 |
| 2002/0008122 | A1 * | 1/2002 | Ritsche et al. | 222/383.3 |
| 2009/0218008 | A1 * | 9/2009 | Law | 141/311 R |
| 2012/0006853 | A1 * | 1/2012 | Lim | 222/256 |

FOREIGN PATENT DOCUMENTS

| | | | |
|---|---|---|---|
| KR | 20-0444659 | Y1 | 5/2009 |
| KR | 10-0935907 | B1 | 1/2010 |

* cited by examiner

COMPACT CONTAINER HAVING AN AIRLESS PUMP

TECHNICAL FIELD

The present invention relates to a compact container having an airless pump, and more particularly to a compact container for discharging a preset amount of cosmetics accommodated therein by pressing a button to operate a pump.

Background Art

In general, a compact container is configured such that pressed powder is accommodated in a container with a preset shape and is applied to a face with a powder puff as an appliance accommodated therein.

However, the pressed powder is flied during the application of the pressed powder and is not closely stuck to a face a little.

Thus, in order to overcome these disadvantages, gel compact cosmetics in which the pressed powder is blended with volatile material are developed and are getting used more widely due to the convenience.

However, according the gel compact cosmetics, the volatile material is gone out in the air so that the gel powder becomes hard, has cracks, and finally is broken when the gel compact cosmetics are exposed to the air.

As such, the internal space of the compact container must be sealed from the exterior so as to prevent the volatile material contained in the gel compact cosmetics from being gone out in the air.

DISCLOSURE

Technical Problem

Therefore, the present invention has been made in view of the above problems, and it is an aspect of the present invention to provide a compact container having an airless pump for preventing volatile material contained in gel compact cosmetics from being gone up in the air.

Technical Solution

In accordance with an aspect of the present invention, the above and other aspects can be accomplished by the provision of a compact container having an airless pump, including: a casing including an upper case and a lower case and accommodating cosmetics; a cylinder fixed to the inside of the lower case and having an annular outer wall downwardly extending from the rim, a depression formed at the center concentric with the outer wall, an opening formed at the lower side of the depression such that the opening communicates with the inner space of the outer wall; a plate upwardly spaced apart from the cylinder and having a discharging hole, formed at the center, through which the cosmetics is discharged, and a through-hole formed at a side thereof; an annular container piston elevating up and down along the inner circumference of the outer wall of the cylinder; an airless pump installed at the depression of the cylinder to discharge the cosmetics accommodated in the cylinder to the outside; and a button formed at the through-hole to operate the airless pump.

Moreover, the plate includes an annular downwardly extending wall formed around the discharging hole, the airless pump include: a piston support including a hollow rod extending upwardly from the center, a plurality of holes formed on the circumference communicating the inside with the outside, and a flange formed at the lower side; an annular inner piston installed between the rod of the piston support and the depression of the cylinder and elevating up and down; and a stem including a protrusion protruding upwardly from the center to close the discharging hole of the plate, an opening formed around the protrusion through which the cosmetic introduced through the hollow inside of the piston support passes, and an annular trench concentric with the protrusion to guide the downwardly extending wall of the plate; and the button includes an auxiliary button seated on the stem and having an elastic downward slope and a main button seated on the auxiliary button and having a protrusion formed at a side and exposed to the through-hole of the plate.

Advantageous Effects

As described above, the compact container having an airless pump according to the present invention has advantages that the airless pump is installed to prevent volatile material in the gel compact cosmetics being gone out in the air to prolong lifespan thereof.

BEST MODE

Hereinafter, a compact container having an airless pump according to an embodiment of the present invention will be described in detail with reference to the accompanying drawings.

Figure 1:
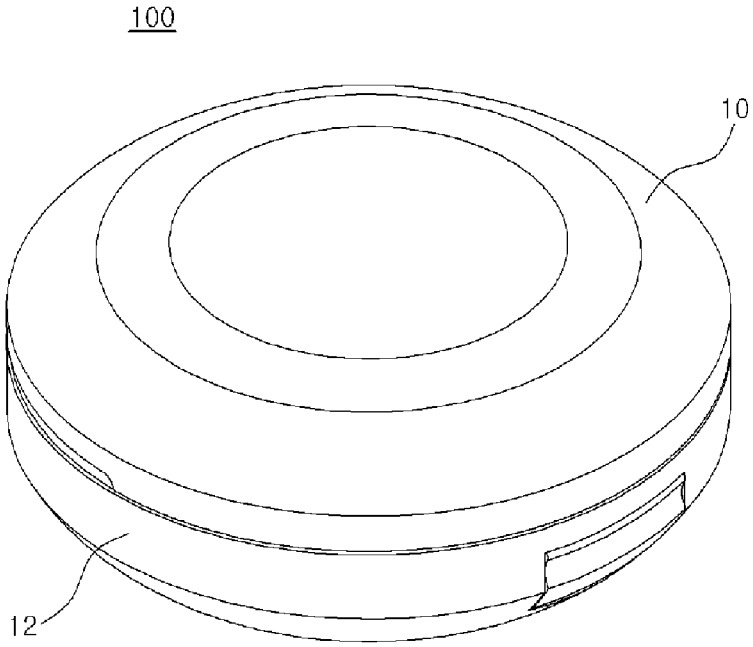
FIG. 1 is a perspective view illustrating an outer appearance of a compact container having an airless pump according to an embodiment of the present invention.
Figure 2:
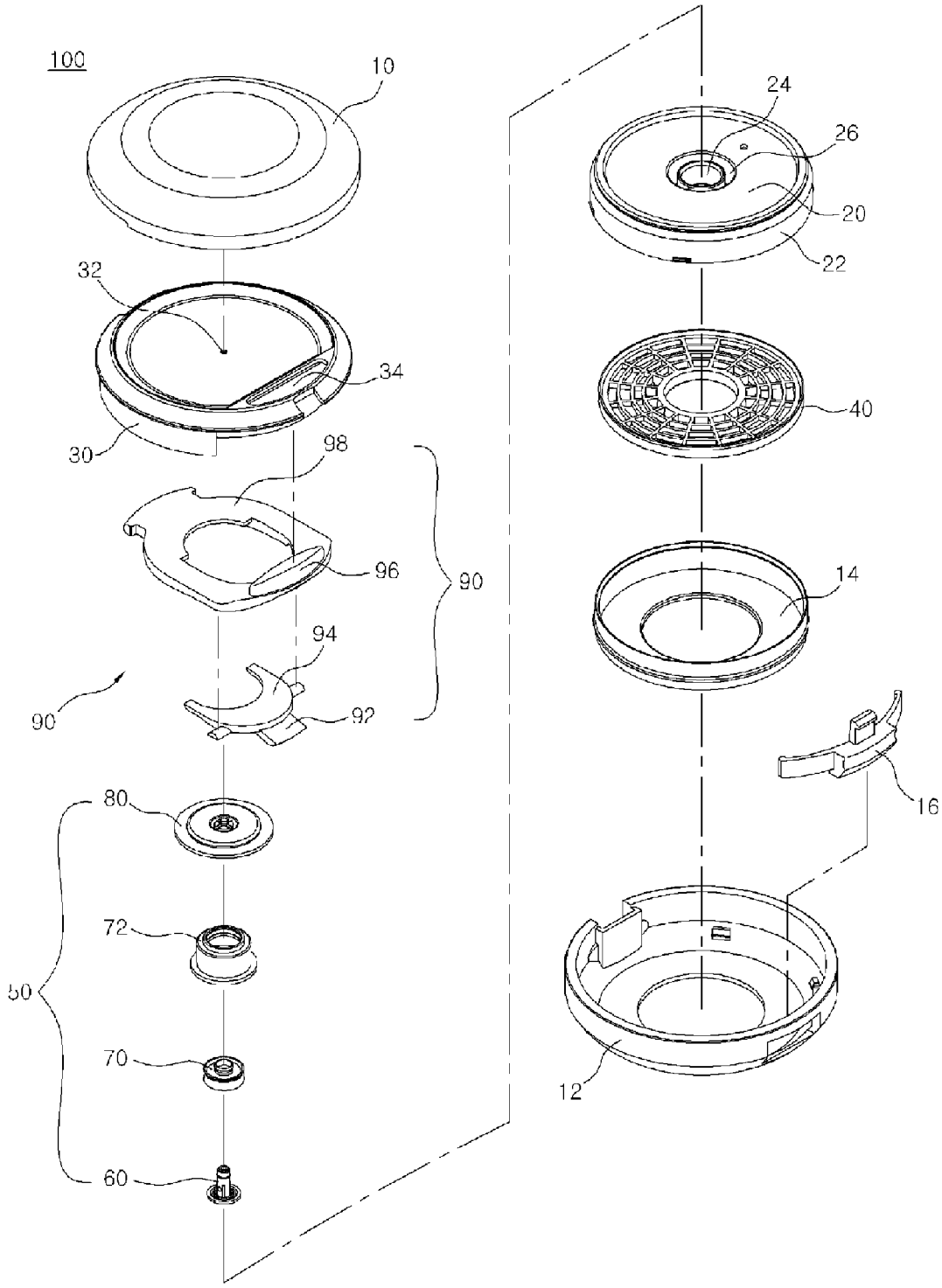
FIG. 2 is an exploded perspective view illustrating the compact container having an airless pump according to the embodiment of the present invention.
Figure 3:
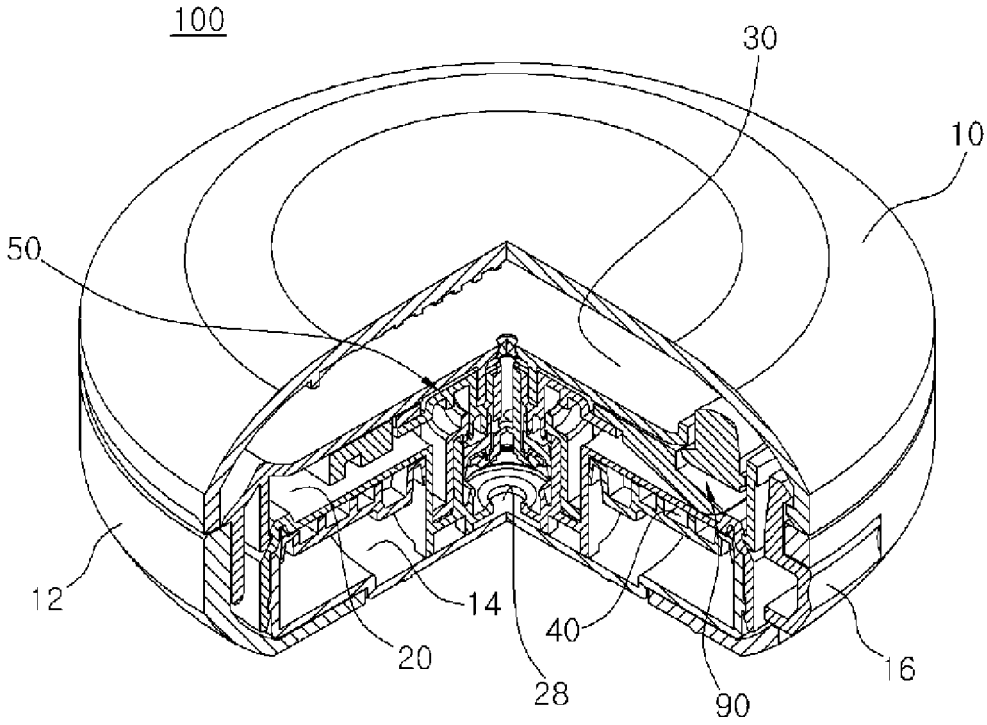
FIG. 3 is a partial sectional view illustrating the compact container having an airless pump according to the embodiment of the present invention.
Figure 4:
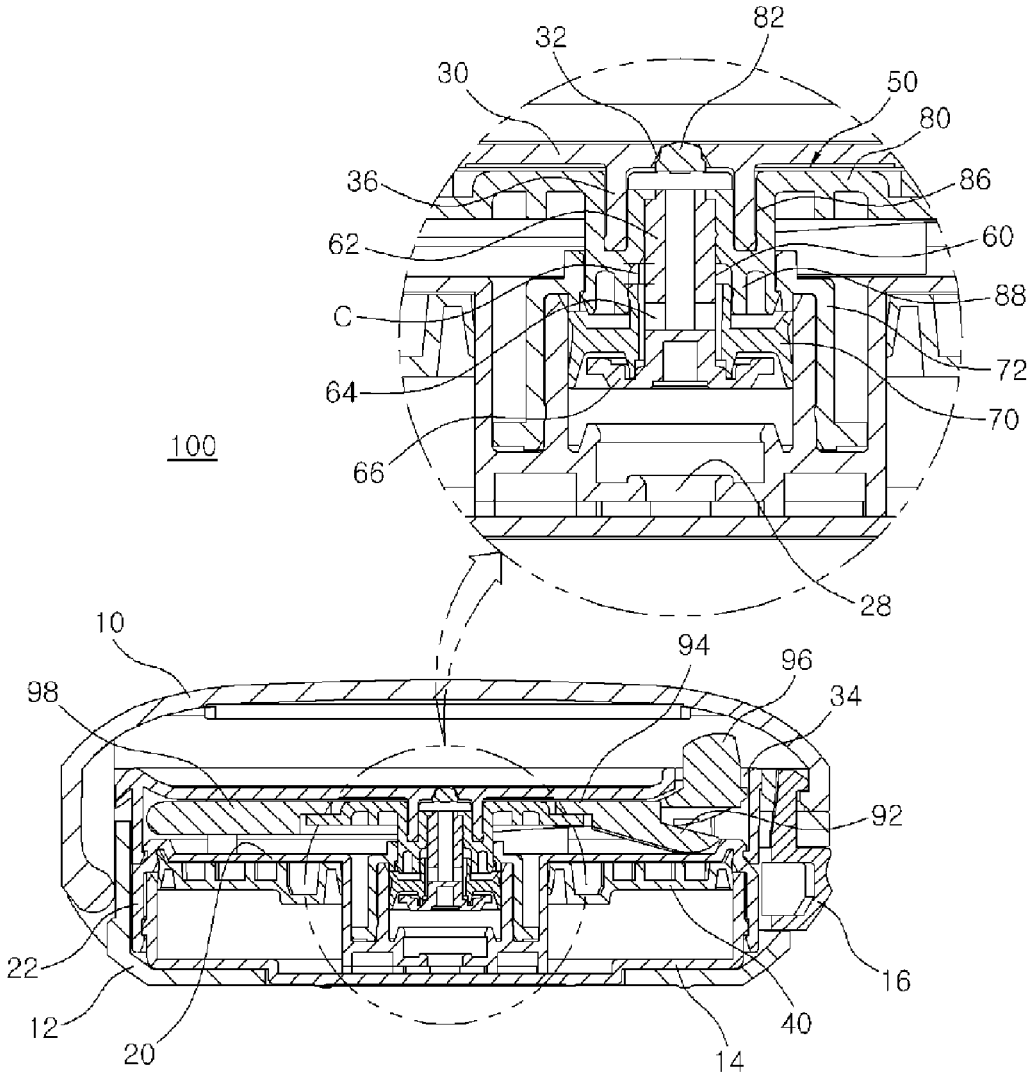
FIG. 4 is a sectional view illustrating the compact container having an airless pump, according to the embodiment of the present invention, when the compact container is closed.
Figure 5:
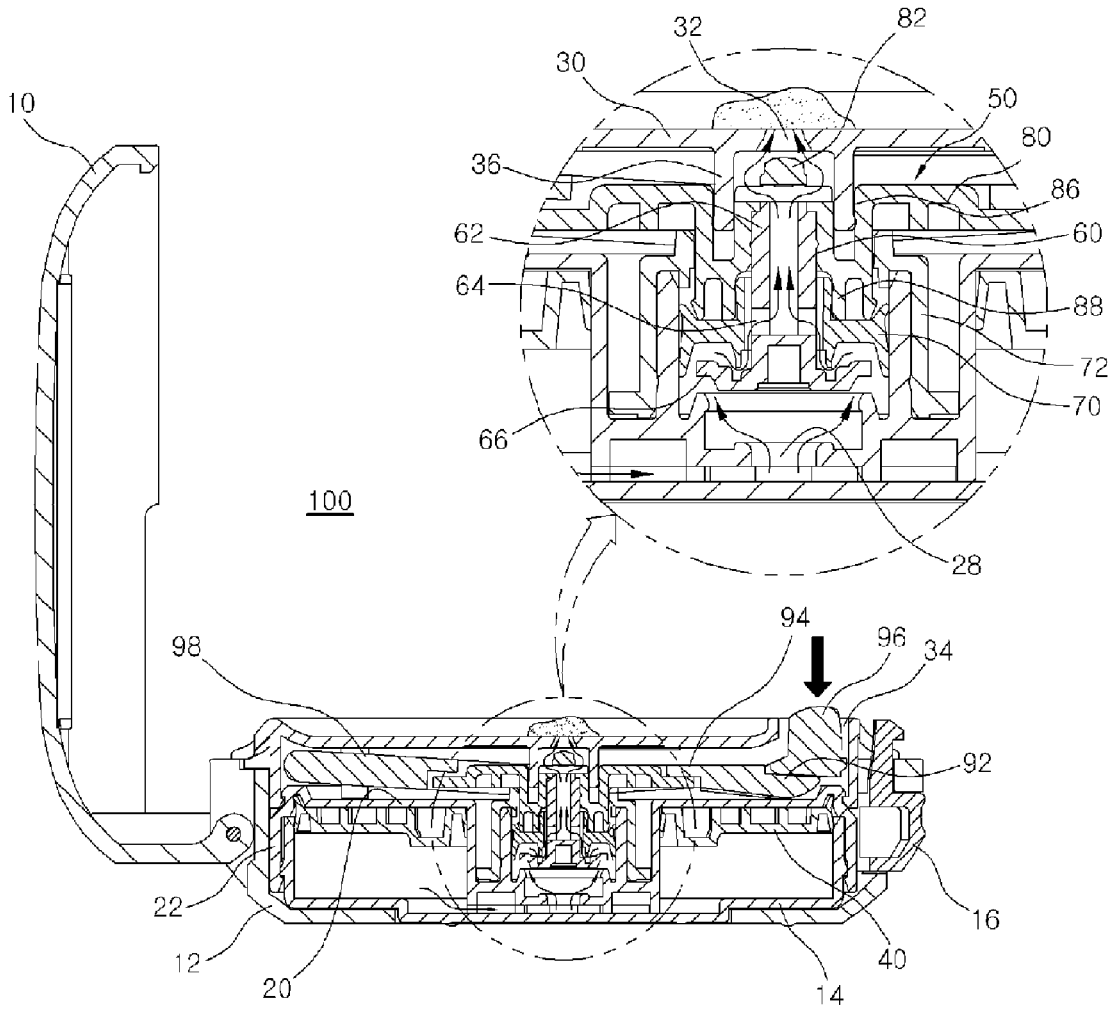
FIG. 5 is a sectional view illustrating the compact container having an airless pump, according to the embodiment of the present invention, when the compact container is opened.

As illustrated in FIGS. 1 to 5, a compact container 100 having an airless pump according to an embodiment of the present invention includes a casing accommodating cosmetics and having an upper case 10 and a lower case 12; a cylinder 20 fixed in the lower case 12 of the casing, a plate 30 upwardly spaced apart from the cylinder 20 and having a discharging hole 32, formed at the center thereof, through which the cosmetics are discharged, an annular container piston 40 elevating up and down along the inner circumference of the cylinder 20, an airless pump 50 pumping out the cosmetics through the discharging hole 32, and a button 90 installed to drive the airless pump 50.

The casing is divided into the upper case 10 and the lower case 12 respectively, wherein the lower case 12 is integrally coupled with an inner case 14. The upper case 10 is hinged to a side of the lower case 12 and is pivoted occasionally. Moreover, a side button 16 is provided at the opposite side of the hinge to hold the upper case 10 temporally.

The cylinder 20 is fixed to the inside of the lower case 12. The cylinder 20 has an annular outer wall 22 extending downwardly from the rim and a depression 24 formed at the center thereof to be concentric with the outer wall 22. Moreover, an opening 28 is formed at the lower side of the depression 24 and an introduction passage 29 is formed at the lower side of the opening 28 such that the cosmetic is introduced into the lower side of the opening 28 through the introduction passage 29. An annular channel 26 is formed in the depression 24 into which a later-described bushing 72 is inserted.

The plate 30 is upwardly spaced apart from the cylinder 20 and has a discharging hole 32 through which the cosmetic is discharged and a through-hole 34 formed at a side thereof to expose the button 90. The plate 30 is preferably downwardly inclined from the outer circumference to the center such that the upper side is easily stuck to the puff after discharging the cosmetic. In addition, a downwardly extending annular wall 36 is provided around the discharging hole.

The container piston 40 has an annular shape to be vertically elevated up and down along the inner circumference of the outer wall of the cylinder 20 and the outer wall of the depression 24. A negative pressure is generated in the container piston 40 when the cosmetic accommodated in the lower side and the container piston 40 is lowered down due to the negative pressure.

The airless pump 50 is a discharging pump discharging the cosmetic that is installed in the depress 24 of the cylinder 20 and includes a piston support 60 disposed at the center of the depress 24 of the cylinder 20, an inner piston 70 installed at the piston support 60 to be elevated up and down, and a stem 80 discharging the cosmetic through the discharging hole 32 of the plate 30.

The piston support 60 includes a hollow rod 62 formed at the center thereof extending upwardly, a plurality of hole 64 formed on the circumferential surface communicating the inside with the outside, and a flange 66 formed at the lower side. Thus, the cosmetic enters through the plurality of holes 64, moves along the hollow inside, and is discharged to the outside.

The inner piston 70 is installed between the rod 62 of the piston support 70 and the depression 23 of the cylinder 20 and elevates up and down along the outer circumference of the rod 62 of the piston support 70. The inner piston 70 has an upper side corresponding to the stem 80 and a lower side corresponding to the flange 66 of the piston support 60.

The stem 80 includes a protrusion 82 protruding upwardly from the center to seal the discharging hole 32 of the plate 30, an opening 84 formed around the protrusion 82 allowing the cosmetic that is introduced through the rod 62 of the piston support 60, and an annular trench 86 concentric with the protrusion 82 guiding the downwardly extending wall 36 of the plate 30. In this case, the trench 86 of the stem 80 includes a leg 88 formed at the lower side to correspond to the inner piston 70. There is a preset gap C between the inner piston 70 and the leg 88 and due to this the inner piston 70 is lowered down sequentially after the stem 80 moves down.

The button 90 includes an auxiliary button 94 seated on the stem 80 and having an elastic downward slope 92 and a main button 98 seated on the auxiliary button 94 and having a protrusion 96 formed at a side to be exposed to the through-hole 34.

Hereinafter, operations of the compact container having an airless pump according to the embodiment of the present invention will be described in detail with reference to the accompanying drawings.

First, a user grasps the lower case 12 of the compact container 100 with a hand and presses the opening button 16 to pivot the upper case 10 with the other hand.

When the upper case 10 is pivoted, the main button 98 exposed through the side of the plate 30 is pressed.

When the main button 98 is pressed, the main button 98 and the auxiliary button 94 press the stem 80 at the same time and the stem 80 starts to move down.

When the stem 80 begins to move down, the piston support 60 coupled with the stem 80 is elevated down at the same time.

When the stem 80 and the piston support 60 move down, a gap is generated between the lower side of the inner piston 70 and the flange 66 of the piston support 60 so that the cosmetic starts to enter.

Moreover, since the protrusion 82 closing the discharging hole 32 of the plate 30 is lowered down while lowering of the stem 80, the discharging hole 32 is opened and the cosmetic starts to be discharged out.

If the stem 80 and the piston support 60 further move down, the stem 80 brings in contact with the inner piston 70 and at the same time the gap between the lower side of the inner piston 70 and the piston support 60 is maximized.

If further lowered down after that, since the stem 80, the piston support 60, and the inner piston 70 are integrally lowered down and the cosmetic is continuously introduced into the airless pump 50 through the gap between the lower side of the inner piston 70 and the flange 66 of the piston support 60, a negative pressure is generated in the cylinder 20.

As such, since the negative pressure is generated in the cylinder 20, the container piston 40 moves down and compensates an empty space generated by the discharge of the cosmetic.

Next, when a user releases the pressed main button 98, the stem 80 and the piston support 60 integrally fixed to the stem 80 move upwardly and the inner piston 70 still stops.

When the stem 80 and the piston support 70 further move upwardly and bring the flange 66 of the piston support 60 in contact with the lower side of the inner piston 70, the passage is closed and the stem 80, the piston support 60, and the inner piston 70 are integrally elevated up.

When the stem 80, the piston support 60, and the inner piston 70 are further elevated up, the protrusion 82 of the upper side of the stem 80 closes the discharging hole 32 of the plate 30.

While the present invention has been shown and described in connection with the exemplary embodiments, it will be apparent to those skilled in the art that modifications and variations can be made without departing from the spirit and scope of the invention as defined by the appended claims.

The invention claimed is:

1. A compact container having an airless pump comprising:

a casing including an upper case and a lower case and accommodating cosmetics;

a cylinder fixed to the inside of the lower case and having an annular outer wall downwardly extending from rim of the cylinder, a depression formed at the center concentric with the outer wall, an opening formed at the lower side of the depression such that the opening communicates with inner space of the outer wall;

a plate upwardly spaced apart from the cylinder and having a discharging hole, formed at the center, through which the cosmetics are allowed to flow out and a through-hole formed at side of the plate;

an annular container piston elevating up and down along the inner circumference of the outer wall of the cylinder;

an airless pump installed at the depression of the cylinder to allow to flow out the cosmetics accommodated in the cylinder wherein the airless pump comprises: a piston support including a hollow rod extending upwardly from the center of the piston support, a plurality of holes formed on the circumference of the piston support for communicating the cosmetic, and a flange formed at the lower side;

an annular inner piston installed between the rod of the piston support and the depression of the cylinder and elevating up and down; and a button unit for operating the airless pump wherein the button unit comprises an auxiliary button seated on the stem and having an elastic downward slope, and a main button seated on the auxiliary button and having a protrusion formed at a side of the main button and inserted into the through-hole of the plate.

2. A compact container having an airless pump comprising:

a casing including an upper case and a lower case and accommodating cosmetics;

a cylinder fixed to the inside of the lower case and having an annular outer wall downwardly extending from rim of the cylinder a depression formed at the center concentric with the outer wall, an opening formed at the lower side of the depression such that the opening communicates with inner space of the outer wall;

a plate upwardly spaced apart from the cylinder and having a discharging hole, formed at the center, through which the cosmetics are allowed to flow out, and a through-hole formed at side of the plate;

an annular container piston elevating up and down along the inner circumference of the outer wall of the cylinder;

an airless pump installed at the depression of the cylinder to allow to flow out the cosmetics accommodated in the cylinder; and a button unit for operating the airless pump wherein the plate includes an annular downwardly extending wall formed around the discharging hole;

wherein the airless pump comprises:

a piston support including a hollow rod extending upwardly from the center of the piston support a plurality of holes formed on the circumference of the piston support for communicating the cosmetic and a flange formed at the lower side;

an annular inner piston installed between the rod of the piston support and the depression of the cylinder and elevating up and down; and a stem including a protrusion protruding upwardly from the center to close the discharging hole of the plate, an opening formed around the protrusion through which the cosmetic introduced through the hollow inside of the piston support passes, and an annular trench which is concentric with the protrusion to guide the downwardly extending wall of the plate;

wherein the button unit comprises an auxiliary button seated on the stem and having an elastic downward slope and a main button seated on the auxiliary button and having a protrusion formed at a side of the main button and inserted into the through-hole of the plate.

* * * * *